US008984925B2

(12) United States Patent
Battenfeld

(10) Patent No.: US 8,984,925 B2
(45) Date of Patent: Mar. 24, 2015

(54) B-SHAPED CRIMPING DIE

(75) Inventor: Kurt Battenfeld, Ebsdorfergrund/Wittelsberg (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 625 days.

(21) Appl. No.: 13/363,601

(22) Filed: Feb. 1, 2012

(65) Prior Publication Data

US 2012/0192614 A1 Aug. 2, 2012

(30) Foreign Application Priority Data

Feb. 2, 2011 (DE) ..... 10 2011 000 464

(51) Int. Cl.
*B21D 37/00* (2006.01)
*H01R 43/058* (2006.01)

(52) U.S. Cl.
CPC ..... *H01R 43/058* (2013.01)
USPC ..... 72/412; 72/414

(58) Field of Classification Search
CPC ..... H01R 4/18; H01R 4/10; H01R 43/042; H01R 43/058; H01R 43/048; H01R 43/04; H01R 4/148; H01R 4/185; B21D 37/00; B21D 37/10; B23K 19/00; B23K 20/12
USPC ..... 72/409, 409.01, 412, 413, 414, 415, 72/462, 467, 468, 470, 473, 474, 475; 29/862, 619, 621, 753, 283.5, 517, 29/748, 751, 861, 863
See application file for complete search history.

(56) References Cited

U.S. PATENT DOCUMENTS

| | | | |
|---|---|---|---|
| 5,500,999 | A | 3/1996 | Yagi et al. |
| 6,098,443 | A | 8/2000 | Muller et al. |
| 6,658,725 | B1 | 12/2003 | Liu et al. |
| 2010/0242568 | A1 | 9/2010 | Battenfeld et al. |

FOREIGN PATENT DOCUMENTS

| | | | |
|---|---|---|---|
| DE | 8605361 | U1 | 4/1986 |
| DE | 19737863 | A1 | 3/1999 |
| DE | 102009001949 | A1 | 9/2010 |

(Continued)

OTHER PUBLICATIONS

European Directive EU 2002/95/EG.

(Continued)

*Primary Examiner* — Edward Tolan
*Assistant Examiner* — Homer Boyer
(74) *Attorney, Agent, or Firm* — Thomas | Horstemeyer, LLC

(57) ABSTRACT

The present invention relates to a B-shaped crimping die for a crimping tool. The crimping tool and the crimping die are used for crimping a plug with an electrical cable located therein into a B-shape. The crimping die comprises a first crimping die half and a second crimping die half. A B-shaped crimping contour is defined by the crimping die halves in a closed state. A first crimping contour part of the first crimping die half and a second crimping contour part of the second crimping die half together build the crimping contour. Two transition points are located at the transitions between the two crimping contour parts. According to the invention an opening angle of a contour of the second crimping die half increases at said transition points in moving direction of the first crimping die half during the crimping process.

3 Claims, 5 Drawing Sheets

(56) References Cited

FOREIGN PATENT DOCUMENTS

| | | |
|---|---|---|
| EP | 2224556 A1 | 9/2010 |
| TW | 175593 | 12/1991 |

OTHER PUBLICATIONS

Wezag, Tools for Professional Application, Issue 2010, relevant pp. 13-19, 21.29, 49-59, 71-75, 105.

Productronic, Issue 7, 2007, Was genau ist eigentlich ein Crimp? pp. 35-36.

Kratt, Volker, Grundlagen der Crimptechnik, self-published, Issue 2005, chapter 07, p. K07/19.

Norm DIN EN 60352-2 2006. Lötfreie Verbindungen—Teil 2: Crimpverbindungen, pp. 31-32.

European search report in copending European application 12152053.0, mailed Apr. 26, 2012.

Taiwanese Search Report in related, co-pending Taiwan Application No. 101103205, issued Nov. 18, 2014.

B-SHAPED CRIMPING DIE

CROSS REFERENCE TO RELATED APPLICATIONS

This application claims priority to co-pending German Patent Application No. DE 10 2011 000 464.5-34 entitled "B-Crimp-Gesenk", filed Feb. 2, 2011.

FIELD OF THE INVENTION

The present invention relates to a B-shaped crimping die for a crimping tool. The crimping die is used for pressing or crimping (in the following "crimping") a female connector, a socket, a jack, a connector, a port, a plug, a sleeve, a contact element or a connector (in the following "plug") with at least one electrical wire or cable (in the following "cable") located therein into a B-shape.

BACKGROUND OF THE INVENTION

So-called "B-crimps" are e.g. produced with manual crimping pliers of the types CS10, CSV10, CS30, CS100 or table crimping devices CS200 of the applicant. However, it is also possible that the crimping tool is a hydraulically actuated crimping tool or any tool actuated by any type of drive.

German standard DIN EN 60352-2 (Version November 2006) describes plugs in the design of crimping sleeves. These crimping sleeves are designated for being crimped by a B-shaped crimping die. At the end of the crimping process, in a rough first approximation the plug has an outer contour in the shape of a "B". It is possible that the vertical leg of the "B" has a convex curvature. Furthermore, it is possible that the middle horizontal leg of the "B" at least partially is not present. Accordingly, it is possible that the B-shaped crimping contour in a middle transitional region between the two curved contour regions terminates at a point. The cable is crimped within the "B" for providing a mechanical connection and/or an electrical connection between the plug and the cable.

B-shaped crimping dies are used for a so-called "cable crimping", wherein the plug is crimped with a stripped cable, or for a so-called "insolation crimping", wherein the plug is crimped with the insolating sleeve of a cable. To name only some examples for options of plugs to be crimped within the B-shaped crimping die, here D-sub contacts male/female, recepticals and terminals (in some cases with lateral port for a cable), cable shoes with closed crimping sleeve, universal tools for different electronic contacts like D-sub contacts or Fsh.6.3/DFK 2, HD20 contacts, HD22 contacts, Modu IV connectors, Postlock contacts, IEC contacts, MQS contacts, MCP 1.5 K contacts, MCP 2.8 K contacts; MCP 6.3/4.8 K contacts, Micro Power Quadlock 5.2, Mini UMNL, Micro Timer, Junior Power Timer, Standard Power Timer TAB 5.8, ABS contacts, SLK 2.8 contacts, MLK 1.2 contacts, LKS contacts, VKS+ contacts, SFK loop spring contacts, VEK spring contacts, flat connectors, MKR/MKS+ contacts, rsA 2+ contacts, RAM−+ contacts, VKR+ contacts, MDK 4/MDK 5 contacts, RAM machined contacts, DFK 3 contacts, FS 2.8+ contacts, AFK/AFS+ contacts, MDK 3 contacts, DFK 40 contacts, MQS contacts, MCP contacts, RSA 2+, MKR−+, MKS−+, RAM−+ contacts, VKR+ contacts, DFK 4 contacts, flat push-on receptacles and taps without insolation sleeve, 1.5/2.5 pin/socket ELA contacts (each sealed or non-sealed and/or insolated or non-insolated in any shape, design and size) are mentioned. With respect to further examples for plugs, it is referred to the advertising brochure "Tools for Professional Application" of the company WEZAG of 2010. However, it is also possible to use the B-shaped crimping dies for other types of plugs.

A basic representation and description of a B-shaped crimping plug both for a "cable crimping" and an "insulation crimping" can be taken from the Journal "Productronic", Issue 7, 2007, pages 35-36.

For crimping a plug in a crimping die, it is necessary to apply large crimping forces. These large crimping forces are provided by manual actuation, a hydraulic drive or any other external drive. Despite of the requirement to apply large crimping forces, there are high demands and specifications for the generated outer surface and contour of the plug at the end of the crimping process.

One problem of present crimping dies is that frequently at the end of the crimping process it is not possible to remove the plug from the crimping contour of the crimping die without applying removal forces. The reason for the need for removal forces is that the plug apparently "adheres" to the crimping die. However, the application of removal forces might result in damages of the plug, the cable or of the produces mechanical or electrical connection between the plug and the cable. The adhesion between the plug and the crimping die originates in particular from the following causes:

Crimping die halves for crimping plugs might comprise a crimping contour which during the crimping process contacts the plug both in the direction of the crimping axis and transverse to this direction. Accordingly, the plug is deformed by the die contour in both directions. In particular in cases where the die contour is built with slanted or curved contour regions, the plug is both plastically and elastically crimped and deformed transverse to the crimping axis at a narrowing of the die contour. At the end of the crimping process the plug is "clamped" transverse to the crimping direction within the die contour which is due to the elasticity of the plug. The afore mentioned effect does not occur for contour regions of the die contour having an orientation transverse to the crimping direction. However, the effect is of increasing importance with an increased slope of the contour regions of the die contour in crimping direction.

According to an alternative or cumulative attempt for an explanation of the adhesive effect it has been estimated that micro "toothings" or micro "meshings" are built between the die and the plug during the crimping process. These micro toothings or micro meshings might be the cause of the undesired increased removal forces.

It is also possible that micro weldings are built between the die and the plug.

For avoiding the above mentioned phenomena, usually lead is used as a base material for the plug or for a surface layer of the plug. Lead serves as a kind of lubricating means for easing the removal. However, the European directive EU 2002/95/EG is directed to a limitation of the use of unhealthful materials in electrical and electronical devices. This European directive aims at the avoidance of the use of heavy metal as lead. According to this European directive, since Jan. 7, 2006 work pieces as the present plugs are not allowed to contain lead.

German patent application DE 10 2009 001 949 A1 of the applicant relates to a simplification of the removal of a work piece (as a fitting for a tube connection, a cable shoe, cable end sleeves, plugs and the like) from a crimping contour of crimping pliers. In the patent application it is proposed to equip the die halves with a certain elasticity. Accordingly, at the end of the crimping process the die is elastically widened, so that the die "breathes". Due to this breathening effect of the die it is possible that the work piece automatically detaches from the die at the end of the crimping process.

U.S. Pat. No. 5,500,999 A describes prior art wherein the plug contacts a first crimping die half defining the contour of the vertical leg of the B. The second crimping die half defines the curved parts of the B. During the crimping process, the second crimping die half is driven towards the first crimping die half. The second crimping die half comprises a bottom region defining the crimping heart. Additionally, the second crimping die half builds inclined surfaces for introducing the plug when moving into the second crimping die half. The opening angles of the inclined surfaces decrease towards the bottom region of the second crimping die half. U.S. Pat. No. 5,500,999 A complains about the problem that at the end position at the end of the crimping process due to the inclined surfaces different heights of crimped work pieces result in a gap x which is built between the two crimping die halves. The width of the gap x depends on the heights of the crimped work piece. The gap x leads to undesired burrs at the outer surface of the crimped plug. U.S. Pat. No. 5,500,999 A suggests equipping the second crimping die half with four contour parts, namely the bottom region with the crimping heart, a transitional region diverging from the bottom region, a tolerance region with parallel contour parts and an introducing region.

In the tolerance region the contour parts have a distance that corresponds to the extension of the first crimping die half transverse to the crimping direction. For work pieces with different heights, the first crimping die half might be located at a plurality of different positions in the tolerance regions at the end of the crimping process without the build-up of any burrs.

Also German patent application DE 197 37 863 A1 discloses a crimping tool with a tolerance region wherein the second crimping die half comprises parallel contour parts having a distance corresponding to the width of the first crimping die half.

OBJECT OF THE INVENTION

It is an object of the present invention to provide a B-shaped crimping die reducing the likelihood that the crimped plug with the cable crimped therein is clamped within or adheres to the crimping die. It is another object of the invention to reduce removal forces for removing the plug with the cable from the crimping die.

SUMMARY OF THE INVENTION

In the closed state of the crimping die at a transition point the crimping contour has a transition from a first crimping contour part (which is defined by a first crimping die half) to a second crimping contour part (which is defined by a second crimping die half). The present invention suggests that at the transition point an opening angle of the contour of the second crimping die half increases when seen in moving direction of the first crimping die half during the crimping process.

According to the invention, the contour of the second crimping die half comprises on both sides of the transition points flat or even guiding surfaces or straight side legs. At the beginning of the cimping process the plug is guided and deformed between these guiding surfaces or side legs. At the transition points the opening angle of the guiding surfaces or guiding side legs changes. By these measures, the invention for the first time allows for a choice of differing opening angles of the two mentioned contour parts or side legs on both sides of the transition points:

The opening angle of the second crimping die half in front of the transition point (when seen in moving direction of the first crimping die half) might be chosen such that the first deformation of the plug is optimized for the introducing phase or for a first partial crimping, wherein the plug is not or not completely deformed in a curved or rolled shape. It is e.g. possible to chose an opening angle in this region which is sufficiently small such that a resulting gap between the two crimping die halves is small enough for avoiding that plastically deformed material of the plug enters into the gap between the crimping die halves. Accordingly, the danger of burrs being built at the end of the crimping process is reduced.

According to the invention, other requirements might be considered by a change of the opening angle in moving direction of the crimping die half behind the transition points: Guiding surfaces or side legs used in this region build the second contour part being part of the crimping contour of the die in the closed state. Accordingly, these guiding surfaces or side legs in the end define the crimped B-shape of the plug in its final state. The opening angles of the crimping die half in this region might be specifically adapted to the B-shaped crimping contour which is to be produced. The opening angle of the second crimping die half in this region might be chosen such that the danger that the plug adheres to or clamps with the B-shaped die is at least reduced. The invention bases on the finding that the danger of a clamping or an adhesion of the plug in the B-shaped crimping die is reduced by an increase of the opening angle of the side legs or guiding surfaces defining the crimping contour.

To name it in other words, the inventive crimping die removes the conflict of objectives according to the prior art: One objective of crimping dies of the prior art is to chose the opening angle of one continuous guiding surface or side leg of the contour of the second crimping die appropriate for introducing the plug into the recess built by the second crimping die half and for providing the initial deformation. The contradictuous objective for crimping dies of the prior art is to optimize the opening angle of continuous guiding surfaces or side legs of the second crimping die part for defining the contour of the plug in the closed state of the B-shaped crimping die and for easing the removal of the plug from the B-shaped crimping die.

According to the invention, the contour of the second crimping die half in front of the transition point (when seen in moving direction of the first crimping die half) comprises straight side legs with an opening angle $\alpha$ of 1° to 7°, in particular 3° to 6°. The contour of the second crimping die half behind the transition point (when seen in moving direction of the first crimping die part) comprises straight side legs with an opening angle $\beta$ of 3° to 20°, in particular 5° to 15°. In any case, according to the invention the opening angle $\alpha$ is smaller than the opening angle $\beta$. To mention only one example, the opening angle $\alpha$ might result from $\alpha=k\times\beta$ with $k=0.5$ (or also $k=0.7$ or $k=0.8$). However, it is also possible that k differs by ±20% from the afore mentioned values.

The present invention covers any type of contour at the transition points for the transition from the opening angle $\alpha$ to the opening angle $\beta$. For one embodiment of the invention, the contour of the second crimping die half is curved at the transition points. The curvature might result from the manufacturing process for shaping the recess of the second crimping die half. However, it is also possible that the curvature results from desired plastic or elastic deformations of the plug or the needs of deformation process of the plug. In case that any influence of the crimping contour in the closed state of the crimping die by the curved design of the transition points is undesired, the curved shape of the contour might be located immediately in front of the transition point such that the curved shape enters with a tangential orientation into the contour of the second crimping die half at and behind the transition point.

For another embodiment of the invention, the contour of the second crimping die half comprises a kink at the transition points. Accordingly, the opening angle of the second crimping die half in moving direction of the first crimping die half changes without a smooth transition but with a sudden increase of the opening angle. This results in a very precise shape of the crimped plug. For a lot of known crimping processes, at the transition points the B-shaped crimping die comprises tolerances in the range of 1/100 mm. These small tolerances might be deteriorated in case of shaping the transition points with smooth transitions or curvatures.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
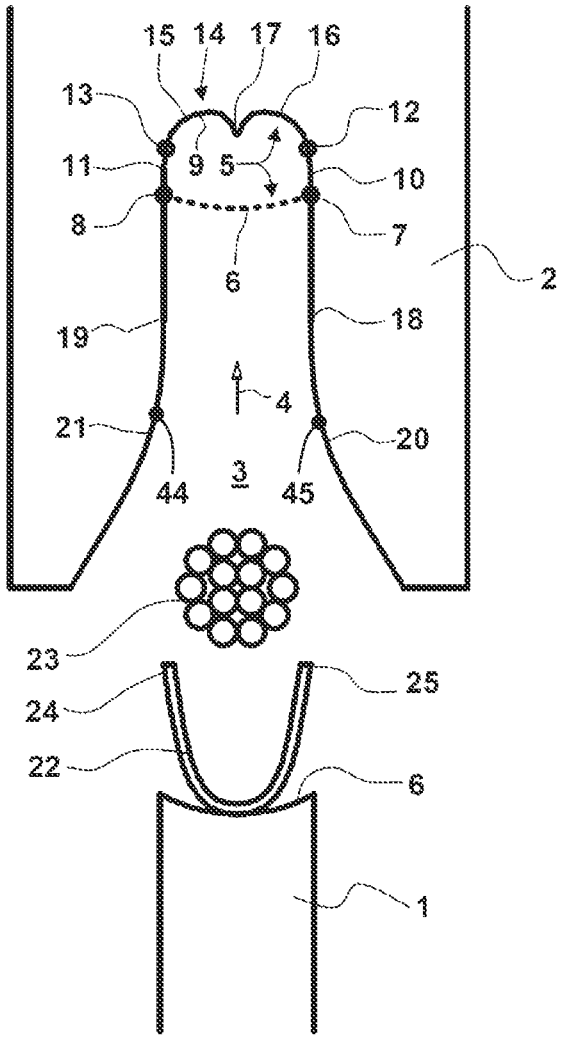
FIG. 1 schematically shows a B-shaped crimping die according to the prior art at the beginning of a crimping process.
Figure 2:
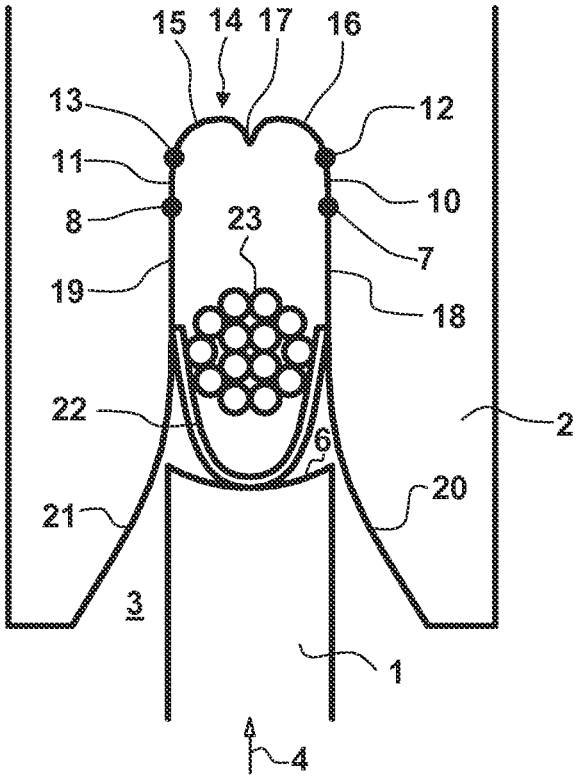
FIG. 2 shows the B-shaped crimping die of FIG. 1 during the crimping process.
Figure 3:
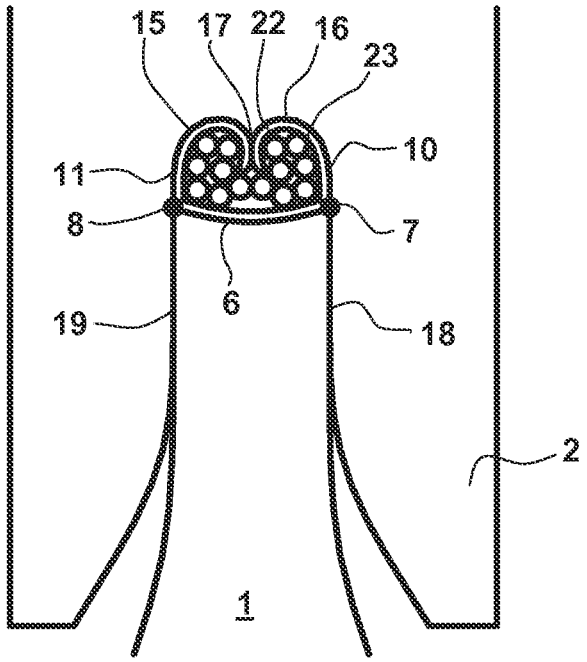
FIG. 3 shows the B-shaped crimping die according to FIGS. 1 and 2 in a closed state at the end of the crimping process.

Referring now in greater detail to the drawings, FIGS. 1 to 3 schematically show the crimping process for crimping a plug with a B-shaped crimping die. At the beginning of the crimping process according to FIG. 1, the first crimping die half 1 is located distant from the second crimping die half 2. The second crimping die half 2 comprises a recess 3 with a given contour. The first crimping die half 1 is introduced into the recess 3 in a crimping or moving direction 4. In a terminal state or closed state that is shown with dashed line in FIG. 1 and shown in FIG. 3, the first crimping die half 1 and the second crimping die half 2 define a cavity with a crimping contour 5 that defines the crimped B-shape of the plug at the end of the crimping process. The crimping contour 5 is built with a first crimping contour part 6. The first crimping contour part 6 is built an defined by a front surface of the first crimping die half. The first crimping contour part 6 at first transition points 7, 8 has a transition to a second crimping contour part 9. The first crimping contour part 6 has a concave shape and builds the vertical leg of the "B" of the B-shaped crimping die. For the shown embodiment, the crimping contour part 6 is curved or built with a segment of a circle. The second crimping contour part 9 is built by the second crimping die half. For a rough simplification, the second crimping contour part 9 generally corresponds to a B with removed vertical leg and removed middle horizontal leg of the B. The upper and lower horizontal legs of the B build second contour legs 10, 11. The second contour legs 10, 11 change to a bottom region 14 of the recess 3 at second transition points 12, 13. The contour of the bottom region 14 (in a rough simplification) corresponds to the simplified drawing of a bird with two concave contour regions 15, 16. The contour regions 15, 16 follow to the second contour legs 10, 11 with a kink or with a tangential orientation. The contour regions 15, 16 in the middle build a tip or the so-called crimping heart 17. The second contour legs 10, 11 for the prior art continue straight (without a kink) over the transition points 7, 8 in the direction opposite to the moving direction with aligned first contour legs 18, 19. Accordingly, the first and second contour legs 10, 18 and 11, 19 for the prior art build straight lines. For the embodiment shown in FIGS. 1 to 3, at the entrance of the recess 3 the first contour legs 18, 19 comprise curved extensions or introducing legs 20, 21.

At the beginning of the crimping process, a V-contoured plug 22 (with a curved region at the connection of the two legs of the V) or a parabolic plug 22 is positioned on the first crimping contour part 6 of the first crimping die half. A cable 23 might be built by any cable, in particular a usual bunched cable with 7 or 19 bunches or a fine-wired cable. The cable 23 is inserted in downward direction into the V build by the plug 22. With a movement of the first crimping die half 1 in moving direction 4, the first crimping die half 1 with plug 22 and cable 23 enters into the recess 3. The end regions 24, 25 of the plug 22 might comprise a larger width than the first crimping contour part 6. For this reason, the first contour legs 18, 19 have no parallel orientation but narrow towards the bottom region 14. The end regions 24, 25 when passing the second transition points 12, 13 are guided along the contour regions 15, 16. This guiding movement coincides with a rolling deformation of the plug 22: the end regions 24, 25 slide along the contour regions 15, 16 and abut at the tip of the crimping part 17. A further movement of the first crimping die half 1 in moving direction 4 has the result that the end regions 24, 25 are pressed in opposite direction to the moving direction 4 into the cable 23. In FIG. 3 the closed state is reached. In the closed state the cable 23 is completely enclosed by the plug 22 crimped into the B-shape. The plug 22 is pressed against the cable 23.

In general, the guidance of the end regions 24, 25 is eased with an increase of the angle between the first contour legs 18, 19. However, an increase of the angle between the first contour legs 18, 19 has the result that a gap between the first crimping contour part 6 and the first contour legs 18, 19 before the end state is increased. This increase of the gap has the result that deformed material of the plug 22 enters into the gap. This effect might lead to burrs at the outer surface of the crimped plug 22 at the end of the crimping process.

An inventive B-shaped crimping die 26 will be described in the following: Generally, the inventive B-shaped crimping die 26 is build corresponding to the above described crimping die. However, the contour 27 of the second crimping die half 2 in the region of the recess 3 is built with straight first contour legs 18, 19 ending at the first transition points 7, 8. The first transition points 7, 8 correspond in the closed state of the B-shaped crimping die 26 shown in FIG. 4 to the location of the transition of the first crimping contour part 6 built by the first crimping die half 1 to the second crimping contour part 9 built by the second crimping die half 2. In the region of the transition points 7, 8 the contour 27 of the second crimping die half 2 comprises a kink. At the kink the contour 27 changes from the first contour legs 18, 19 to straight second contour legs 10, 11. The straight second contour legs 10, 11 change at second transition points 12, 13 to the curved contour regions 15, 16, wherein the transition might be built by a kink or with a tangential transition from the second contour legs 10, 11 to the curved contour regions 15, 16.

Figure 4:
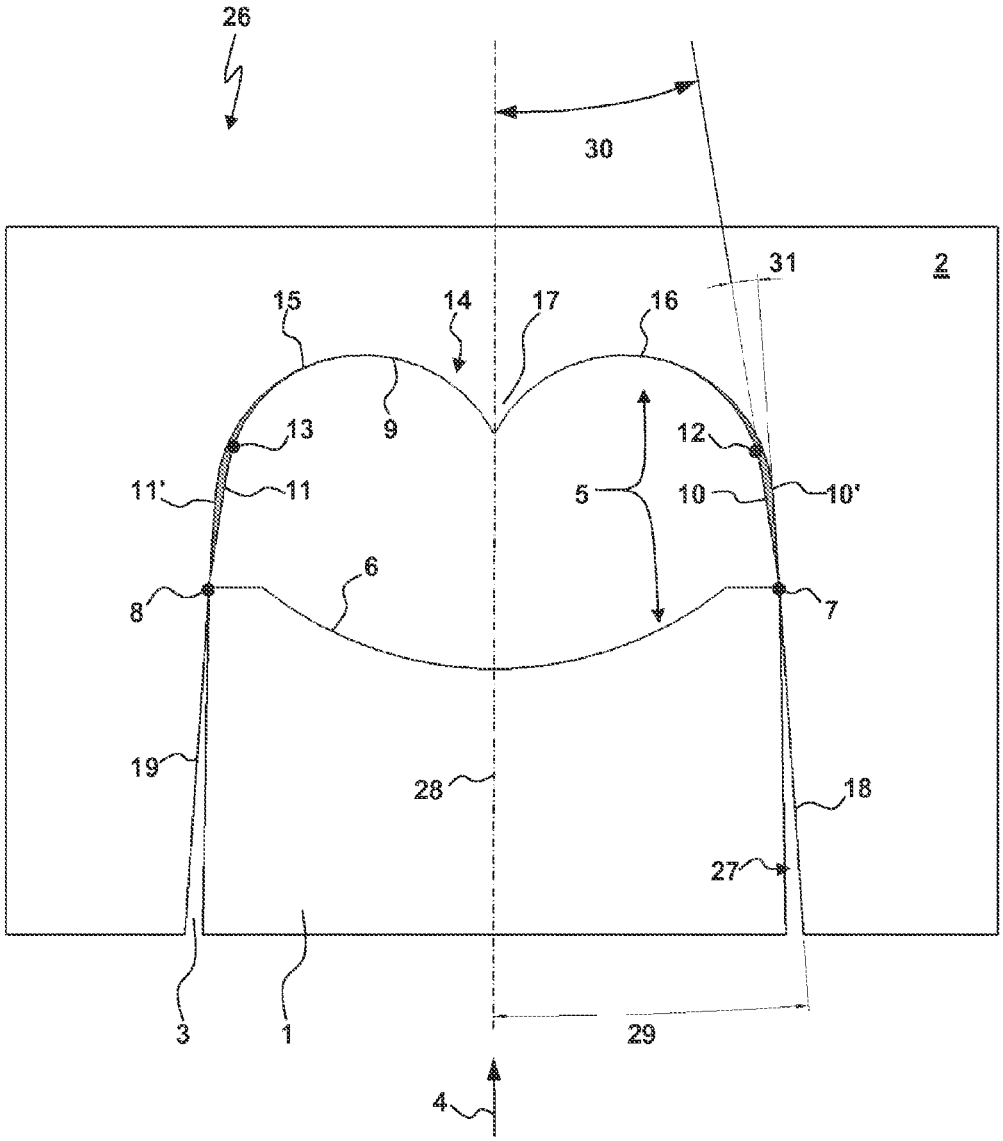
FIG. 4 schematically shows an inventive B-shaped crimping die with a first crimping die half and a second crimping die half.

In FIG. 4, with the imaginary second contour legs 10', 11' the orientation of the side legs according to the prior art with a straight extension of the first contour legs 18, 19 is indicated for underlining the difference of the inventive embodiments from the embodiments known from the prior art. From the inventive design, the grey colored difference area results as shown in FIG. 4. From this presentation it can be seen that corresponding to an inventive change of the orientation of the second contour legs 10, 11 also a changed contour of the contour regions 15, 16 results. In particular, a curvature or bending of the contour regions 15, 16 in increased.

The first contour legs 18, 19 comprise an opening angle $\alpha$ with respect to the moving direction 4 or a symmetry axis 28 of the second crimping die half 2. In FIG. 4, the opening angle $\alpha$ is denoted with reference numeral 29. The second contour legs 10, 11 comprise opening angles $\beta$ with respect to the moving direction 4 or a symmetry axis 28 of the second crimping die half 2. In FIG. 4, the opening angle $\beta$ is denoted with reference numeral 30. Accordingly, a difference angle $\chi$ is built between the contour legs 10, 18 as well as between the contour legs 11, 19. In FIG. 4, the difference angle $\chi$ is denoted with reference numeral 31. The person with skill in the art will understand that the chosen design of the second crimping contour part 9 in the bottom region 14 shown in the figures is not limiting—instead, within the frame of the present invention, any differing crimping contour part 9 in the bottom region 14 might be used.

Figure 5:
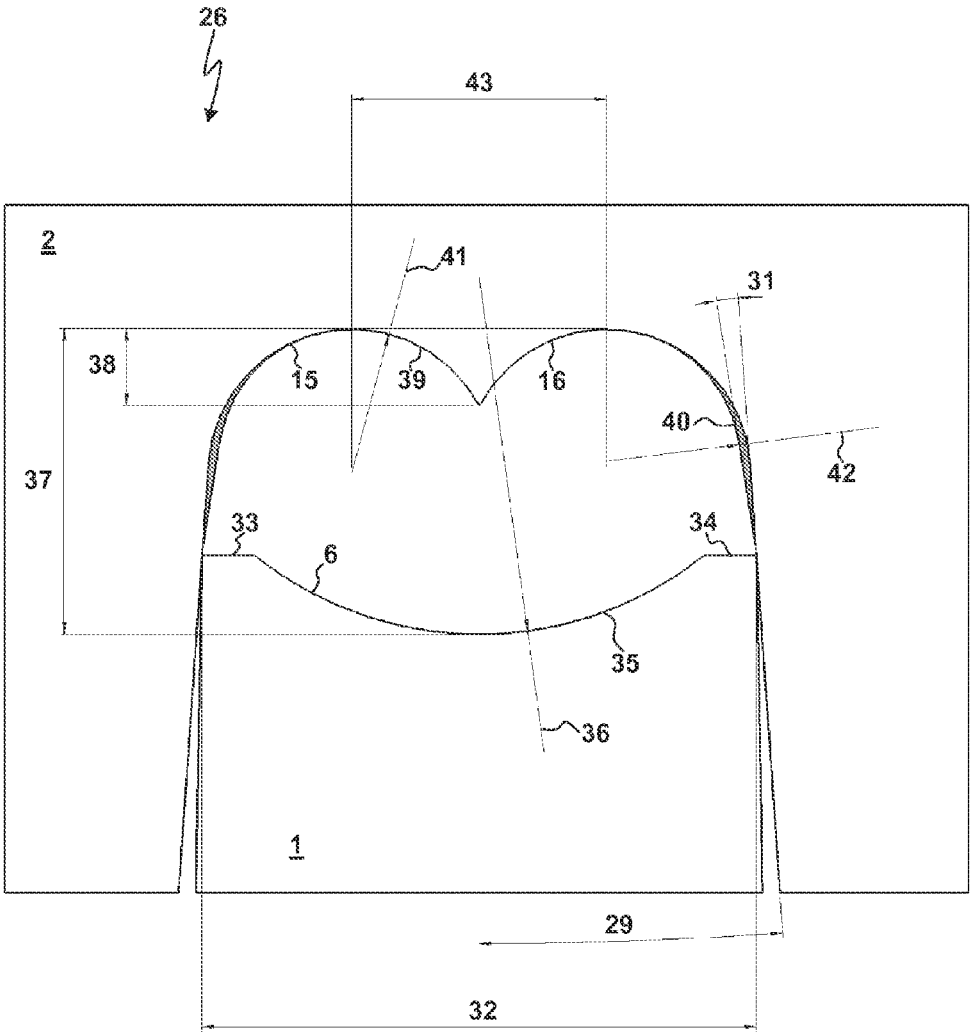
FIG. 5 shows another B-shaped crimping die with characteristic values of the geometry of the same.

In FIG. 5, possible geometries of the B-shaped crimping die 26 with the first crimping die half 1 and the second crimping die half 2 are further specified. The given geometries only build one possible example of an inventive B-shaped crimping die 26 without the intension of limiting the present invention to these geometries. A width 32 of a front surface of the first crimping die half 1 and so of the first crimping contour part 6 is 3.86 mm. The opening angle $\alpha$ according to reference numeral 29 is 4°. The first crimping contour part 6 has not an even or flat design. Instead, the first crimping contour part 6 is built with two outer plane plateaus 33, 34 and an inner concave circular segment 35 having a radius 36 of 2.5 mm. A maximal distance 37 of the B-shaped crimping die 26 in moving direction 4 (so the maximal distance of the first crimping contour part 6 from the second crimping contour part 9) is 2.13 mm. The crimping heart 17 has an extension 38 in the bottom region 14 towards the first crimping contour part 6 of 0.53 mm. The angle $\chi$ denoted with reference numeral 31 is 5° so that the angle $\beta$ (denoted with reference numeral 30) is 9°. The contour regions 15, 16 are each built with two circle segment contours 39, 40. A radius 41 of the circle segment contour 39 is 1 mm, whereas a radius 42 of the circle segment contour 40 is 0.92 mm. A distance 43 of a center of the circle segment contour 39 of the contour region 15 from a center of the circle segment contour 40 of the contour region 16 is 1.77 mm.

The inventive B-shaped crimping die 26 might be used for any tool, in particular for crimping pliers, a hydraulically actuated crimping tool or a crimping machine driven by any type of drive.

As explained in the beginning, the inventive B-shaped crimping die 26 might be used for a plug 22 of any design with at least one cable 23 in any design.

During the crimping process, with the initial movement of the first crimping die half in moving direction 4 the end regions 24, 25 of the plug 22 for the first time contact the second crimping die half 2 at contact points 44, 45 of the first contour legs 18, 19 or at the extensions 20, 21. With the further movement in moving direction 4, the end regions 24, 25 are continuously and without any interruption deformed towards each other, so transverse to the moving direction 4. The contour of the second crimping die half 2 narrows continuously and without interruption from the contact points 44, 45 towards the bottom region 14. However, according to the invention the amount of narrowing changes at the first transition points 7, 8. Any known manufacturing process might be used for manufacturing the B-shaped crimping die 26 and for shaping the contours of the die halves. To name only some examples, the B-shaped crimping die 26 might be manufactured with a wire electric discharge machining or wire eroding, a grinding process and/or a milling process. It is also possible that the described contours are stored in a computer numerical control machine used for manufacturing the contours of the B-shaped crimping die 26. The surface roughnesses of the manufactured contours should be kept as small as possible which might be provided by a polishing manufacturing process. An additional hardening process might be applied to the contours, in particular at the transition points 7, 8.

In the present invention, the second crimping die half denotes the crimping die half defining the bottom region 14 and the contour regions 15, 16 as well as the crimping die heart 17 and the second crimping contour part 9. The first crimping die half 1 denotes the crimping die half defining the first crimping contour part 6, so forming the vertical leg of the B. Accordingly, this definition is independent on further criteria. In particular, for the use of "first" and "second" crimping die half it does not matter which of these halves is moved and which half is resting.

In the present patent application, an embodiment is described wherein the first crimping die half 1 is moved towards the resting second crimping die half 2. The first crimping die half 1 enters into the recess 3 and approaches the bottom region 14. However, the inventive measures might be applied for any embodiment with a relative movement between the two crimping die halves 1, 2. In particular, the invention also covers an embodiment wherein the first crimping die half 1 is resting whereas the second crimping die half 2 is moved. The invention also covers an embodiment where both crimping die halves 1, 2 are moved towards each other.

Many variations and modifications may be made to the preferred embodiments of the invention without departing substantially from the spirit and principles of the invention. All such modifications and variations are intended to be included herein within the scope of the present invention, as defined by the following claims.

I claim:

1. B-shaped crimping die for a crimping tool for crimping a plug with an electrical cable located therein into a B-shape, comprising a) a first crimping die half defining a first crimping contour part b) a second crimping die half defining a second crimping contour part, c) a B-shaped crimping contour built in a closed state of the crimping die halves, said B-shaped crimping contour being defined by said crimping contour parts with transition points from one crimping contour part to the other crimping contour part, wherein d) a contour of said second crimping die half is built da) with straight first contour legs having opening angles $\alpha$ in the range of 1° to 7°, said first contour legs being located in front of said transition points when seen in moving direction of said first crimping die half during the crimping process and db) with straight second contour legs having opening angles $\beta$ in the range of 3° to 20°, said second contour legs being located behind said transition points when seen in moving direction of said first crimping die half during the crimping process, e) said opening angles $\alpha$ of said first contour legs are smaller than said opening angles $\beta$ of said second contour legs.

2. The crimping die of claim 1, wherein said contour of said second crimping die half is curved at the transition points.

3. The crimping die of claim 1, wherein said contour of said second crimping die half comprises a kink at the transition points.

* * * * *